US006733252B2

(12) United States Patent
Feygin et al.

(10) Patent No.: US 6,733,252 B2
(45) Date of Patent: May 11, 2004

(54) FLUID-HANDLING SYSTEMS AND COMPONENTS COMPRISING A BLADDER PUMP, A METHODS THEREFOR

(75) Inventors: Ilya Feygin, Mountainside, NJ (US); John M. Newsam, San Diego, CA (US)

(73) Assignee: fqubed, San Diego, CA (US)

( * ) Notice: Subject to any disclaimer, the term of this patent is extended or adjusted under 35 U.S.C. 154(b) by 0 days.

(21) Appl. No.: 10/143,403

(22) Filed: May 10, 2002

(65) Prior Publication Data

US 2003/0210985 A1 Nov. 13, 2003

(51) Int. Cl.[7] ..... F04B 43/10; F04B 49/00; F04B 9/08; F04B 43/08; F04B 19/24

(52) U.S. Cl. ..... 417/394; 417/46; 417/43; 417/383; 417/478; 417/53

(58) Field of Search ..... 417/394, 46, 43, 417/383, 385, 389, 478, 53; 222/145.5, 145.6, 459, 95, 386.5; 141/9, 100, 105, 106, 107, 18, 25, 26, 21; 366/190

(56) References Cited

U.S. PATENT DOCUMENTS 3,604,016 A * 9/1971 Robinson et al. ..... 623/3.21
3,725,086 A * 4/1973 Horner ..... 426/413
4,053,141 A * 10/1977 Gussefeld ..... 366/339
4,111,613 A * 9/1978 Sperry ..... 417/394
4,417,861 A * 11/1983 Tolbert ..... 417/315
4,997,553 A * 3/1991 Clack ..... 210/97
5,171,207 A * 12/1992 Whalen ..... 600/16
5,184,757 A * 2/1993 Giannuzzi ..... 222/82
5,273,406 A * 12/1993 Feygin ..... 417/474
5,743,878 A * 4/1998 Ross et al. ..... 604/131
5,788,122 A * 8/1998 Keller ..... 222/137
5,797,517 A * 8/1998 Weinstein ..... 222/95
5,810,202 A * 9/1998 Hoback et al. ..... 222/95
5,899,362 A * 5/1999 Moran ..... 222/136
5,993,172 A * 11/1999 Schuman et al. ..... 417/394

* cited by examiner

*Primary Examiner*—Justine R. Yu
*Assistant Examiner*—Timothy P. Solak
(74) *Attorney, Agent, or Firm*—DeMont & Breyer, LLC

(57) ABSTRACT

A fluid-handling system capable, in various embodiments, of storing, mixing, and dispensing fluids, and also regulating the flow of fluids. The system includes a cartridge having a non-expandable housing, and a bladder within the housing. In some variations, a drive-liquid is introduced into a region between the housing and the bladder, which causes fluid contained within the bladder to dispense. In some other variations, the drive-liquid is introduced into the bladder, which causes the bladder to expand and expel fluid that is contained with the housing.

15 Claims, 6 Drawing Sheets

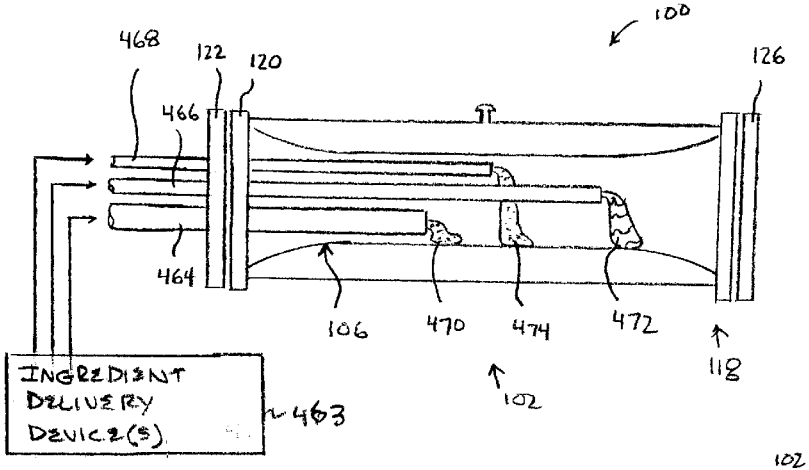
FIG. 4A
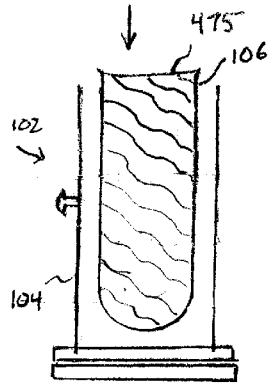
FIG. 4B
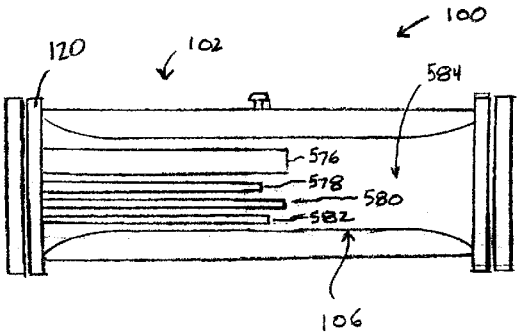
FIG. 5
FIG. 6
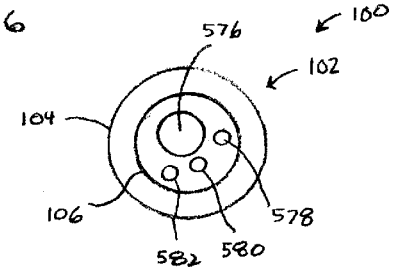
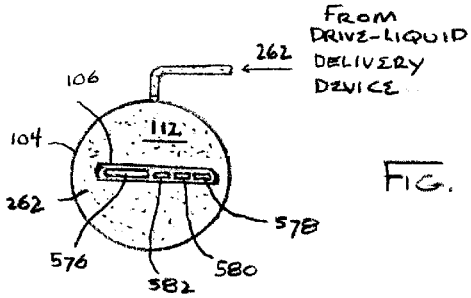
FIG. 7
FIG. 8A
FIG. 8B
FIG. 8C
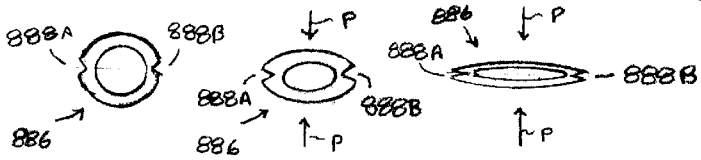

100

140A
150A
146
148A
1206 A
DRIVE-LIQUID DELIVERY DEVICE
CONTROLLER
SET POINT
144A
1204A
142A
254A
TO COMMON RECEIVER
136A
102A
140B
150B
146
148B
1206 B
DRIVE-LIQUID DELIVERY DEVICE
CONTROLLER
SET POINT
144B
1204B
142B
254B
TO COMMON RECEIVER
136B
102B
140C
150C
146
148C
1206 C
DRIVE-LIQUID DELIVERY DEVICE
CONTROLLER
SET POINT
144C
142C
1204C
254C
TO COMMON RECEIVER
136C
102C
140D
150D
146
148D
1206 D
DRIVE-LIQUID DELIVERY DEVICE
CONTROLLER
SET POINT
144D
142D
1204D
254D
TO COMMON RECEIVER
136D
102D

FIG 14A
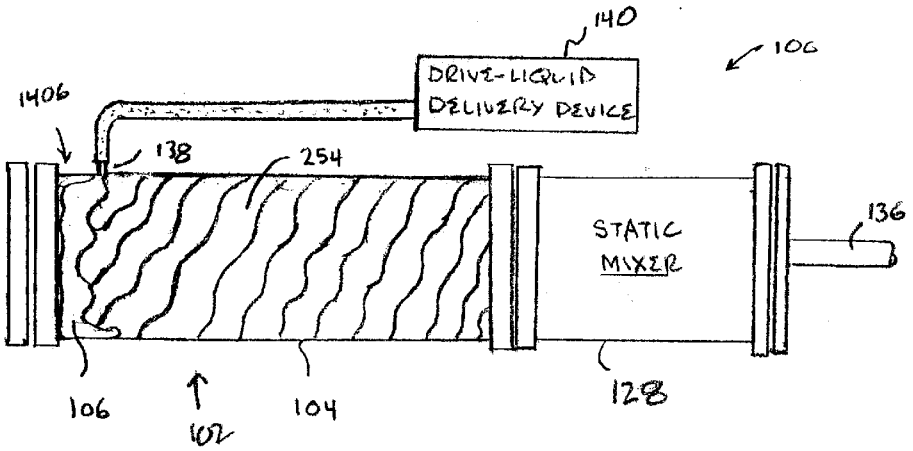
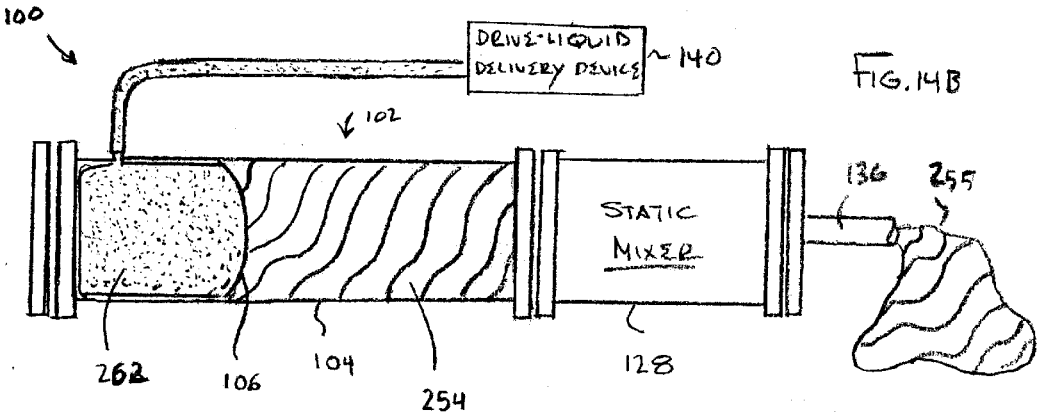
FIG. 14B
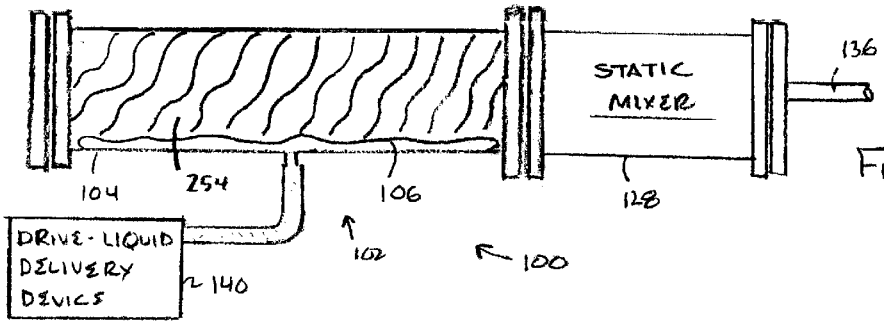
FIG. 15A
FIG. 15B
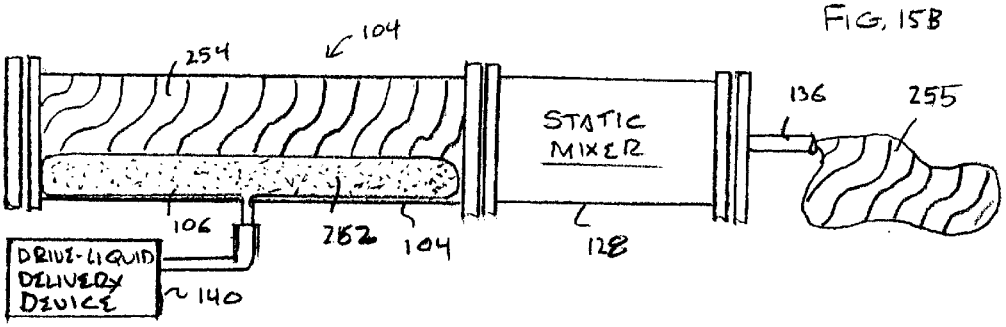

FLUID-HANDLING SYSTEMS AND COMPONENTS COMPRISING A BLADDER PUMP, A METHODS THEREFOR

FIELD OF THE INVENTION

The present invention relates generally to fluid-handling systems, and more particularly to devices or systems that are capable of formulating, storing, dispensing, or regulating the flow of fluids.

BACKGROUND OF THE INVENTION

The development, production and sales of countless industrial and consumer products involve fluid-handling operations (e.g., flow regulation, dispensing fluids, storing fluids, mixing fluids, etc.). Fluid-handling systems are used to perform these operations.

One application for fluid-handling systems is in the production of "formulations." Formulations are produced by the physical combination of two or more fluids or fluidized ingredients. Formulation ingredients are often liquid, or otherwise liquefied, so that they flow under appropriate conditions.

To create a formulation, the ingredients are usually transported (e.g., pumped, etc.) to a receiver, where they are physically (and sometimes chemically) combined, typically in precise amounts. For some formulations, this "combining" operation occurs in a production facility; for others, it occurs at the point of sale by a retailer, etc. Once a formulation is produced, it is typically packaged and then, at an appropriate time, dispensed for use. For some applications, an ability to dispense a precise amount of the formulation is required; for some others, it's not.

Many different products are properly characterized as "formulations" under the definition provided above. Examples include personal-care products (e.g., shampoo, perfume, etc.), household cleaning products ((e.g., liquid dishwashing detergents and clothes-cleaning detergents, etc.), foods (e.g., cream cheese, ice cream, margarine, etc.), industrial products (e.g., engine oil, lubricants, industrial cleaners, etc.), adhesives (e.g. glues, resins, etc.), paints and coatings, pharmaceutical products, and electronics "chemicals" (e.g., solder masks, etch resist masks, etc.), to name but a few.

The products listed above, which are but a small subset of the universe of formulated products, vary widely as to their rheological properties. Furthermore, formulation applications present substantial application-to-application differences in the relative amounts of ingredients and in the amount of product being formulated. Compare, for example, commercial-scale production of a food (e.g., mayonnaise, etc.) versus a point-of-sale apparatus for formulating paints in one-quart to five-gallon batches (e.g., for home-owners, etc.). Additionally, the specific fluid-handling operations being performed will vary (e.g., transporting vs. mixing vs. dispensing, etc.). Consequently, fluid-handling systems and components that are used for the production of formulations are implemented in a wide variety of application-specific designs and configurations.

By way of example, for some formulation applications, fluid-handling systems include special pumps that are used to pressurize liquid for transport or dispensing. In some other applications, syringes are used to deliver product. In yet further applications, pipettes are coupled to systems capable of pressurizing fluids for dispensing. Often, fluid-handling requires emulsification or mixing of ingredients. Some fluid-handling systems are available as "bottle-top" dispensers that directly couple to a bottle of liquid to dispense the liquid contained therein. But some other systems are quite complicated and include their own fluid reservoirs, control systems, etc.

Some formulation ingredients and formulated products present special difficulties for fluid-handling systems. For example, formulation ingredients (or formulated products) that are high-viscosity liquids, high-solids-concentration liquid suspensions, non-Newtonian fluids, and the like cause problems for rotating equipment, such as pumps. Among other problems, it is difficult to control the flow rate of such materials. Consequently, special pumps are required.

Furthermore, as implied above, some prior-art fluid-handling systems are equipment-intensive. In particular, these systems typically include one fully-controllable pump for each ingredient in the formulation. Such systems are often relatively expensive. And prior-art fluid-handling systems often require substantial maintenance. This maintenance includes servicing the rotating equipment (e.g. pumps, etc.) to keep it operational and cleaning the system regularly to prevent clogging. Clogging is particularly likely when the formulation ingredients are high-viscosity liquids, polymerizable materials, and high-solids-concentration suspensions. Additionally, to avoid contamination, these systems must be cleaned whenever the formulation is changed.

The art would therefore benefit from a fluid-handling system that, among another attributes, has a configuration or structure that is less application-sensitive than prior-art systems. In particular, the fluid-handling system should possess at least some of the following attributes:

- Suitable for use with products over a wide range of rheological properties (e.g., low viscosity to high viscosity, etc).
- Suitable for use over a wide range of capacity (e.g., flow rate, amount of ingredients, etc).
- Not as maintenance-intensive as prior-art fluid-handling systems.
- Suitable for use in a variety of applications (e.g., storage, mixing, dispensing, etc.).

SUMMARY OF THE INVENTION

A fluid-handling system that avoids some of the problems of the prior art is disclosed. Some fluid-handling systems in accordance with the present invention are generally suitable for use with products over a wide range of rheological properties, can accommodate wide variations in the amount of fluid being handled, are less maintenance-intensive than some prior art systems, and are capable of performing a variety of fluid-handling functions.

In various embodiments, a fluid-handling system in accordance with the illustrative embodiment of the present invention is capable of performing one or more of the following functions, among any others: receiving and storing one or more fluids, keeping stored fluids separate from one another, mixing two or more fluids to formulate a product, accurately dispensing fluid, and regulating a flow of fluid.

The specific configuration of a fluid-handling system in accordance with the illustrative embodiment is dependent, to some extent, on its intended use. More particularly, certain features or elements are included in some variations of the system but not in some others, as a function of the intended use of the system. Certain elements are, however, basic to all variations of a fluid-handling system in accordance with the present invention. In particular, basic to all variations is a cartridge that has a bladder and a substantially non-expandable housing. The bladder is disposed within the housing.

A fluid-handling system in accordance with the illustrative embodiment optionally includes a drive-liquid delivery device. This device is capable, in accordance the illustrative embodiment, of delivering liquid ("drive-liquid") to a region that is within the housing but outside of the bladder. When sufficiently pressurized, the drive-liquid exerts a force against the bladder that results in the expulsion any fluids that are contained within the bladder. In other words, the fluid is indirectly "pumped" such that it does flow through the drive-liquid delivery device. Consequently, if a change is made in the fluid (e.g., new ingredients, etc.), it is accommodated, in some embodiments, by changing the bladder. Generally far less cleaning is required to accommodate a change in fluid than for most prior-art liquid handling systems.

In a variation of the illustrative embodiment, drive-liquid is delivered to the interior of the bladder, rather than outside of the bladder. As the bladder expands, it expels any fluids that are contained with the housing (but outside of the bladder). While this variation might entail more maintenance than the illustrative embodiment, it has certain advantages, as described later in this specification.

In some variations of the illustrative embodiment, fluid-handling systems include multiple (i.e., two or more) cartridges that are coupled to one another. In some of those variations, the bladders are also coupled to one another so that fluid can pass from one bladder to the next. Multi-cartridge arrangements are particularly well suited for conducting experimentation, such as, for example, permuting the order in which ingredients are combined to produce a formulation. Multi-cartridge arrangements are also well adapted to mixing fluids by moving them back and forth between adjacent cartridges, possibly through an orifice structured to promote mixing. As suits the requirements of a particular application, multiple cartridges can be configured in serial or parallel fashion, etc.

In some variations of the illustrative embodiment, an optional control system is coupled to a cartridge, enabling the cartridge to be used as a flow regulator. In such variations, a sensor (e.g., a force sensor, etc.) senses a flow rate, pressure, etc., of a fluid that is flowing out of the cartridge. The sensor generates and outputs, to a controller, a signal that is representative of the flow rate (or pressure, etc.) of the fluid. The controller compares that signal to a set point. Based on a deviation between the sensor output signal and the set point, the controller generates and outputs a control signal. The control signal is output to a final control element, such as the drive-liquid delivery device. The control signal alters the operation of the drive-liquid delivery device, etc., as appropriate, to adjust the flow of fluid from the cartridge to a desired rate.

Large changes in the amount of fluid being handled are accommodated, in some variations of the illustrative embodiment, by changing bladder size. In some other variations, the cartridge itself (i.e., housing and bladder) is replaced by a different cartridge (more suitably sized for the changed quantity of fluid).

These and other variations of a fluid-handling system in accordance with the illustrative embodiment of the present invention are illustrated in the Drawings and described further in the Detailed Description section of this specification.

BRIEF DESCRIPTION OF THE DRAWINGS

FIG. 4A depicts the fluid-handling system of FIG. 1 with tubes that deliver fluid to the bladder.

FIG. 4B depicts a variation of the fluid-handling system of FIG. 1, wherein the bladder is pre-filled with fluid and then placed in the housing.

FIG. 5 depicts a variation of the fluid-handling system of FIG. 4A wherein the tubes are sealed at one end or both ends and retain their fluid ingredients until the bladder is collapsed.

FIG. 6 depicts a cross-section of the fluid-handling system of FIG. 5 before the bladder is collapsed.

FIG. 7 depicts a cross-section of the fluid-handling system of FIG. 5 after the bladder is collapsed.

FIGS. 8A–8C depict, in various stages of collapse, a cross-section of a collapsible tube, wherein the tube has two notches that run in an axial direction at diametrically-opposed locations on the tube, in accordance with a variation of the illustrative embodiment of the present invention.

FIG. 14A depicts a variation of the illustrative fluid-handling system, wherein the housing, not the bladder, receives fluid. FIG. 14A depicts the bladder in a collapsed state.

FIG. 14B depicts the fluid-handling system of FIG. 14A as drive liquid is added to the bladder, thereby forcing the fluid that is within the housing but outside of the bladder to be expelled from the housing.

FIG. 15A depicts a variation of the fluid-handling system shown in FIG. 14A.

FIG. 15B depicts the fluid-handling system of FIG. 15A as drive liquid is added to the bladder.

DETAILED DESCRIPTION

The terms listed below are given the following definitions for use in this specification.

"Fluid" means: gases, vapors, material(s) that are liquid at room temperature, materials that are liquefied by various physical processes, liquid suspensions (e.g., material(s) that are suspended in a liquid carrier, etc.), slurries, even solids that have properties that allow them to "flow," (e.g., fluidized solids, etc.). In essence, the term "fluid" means a gas, liquid or solid that is "naturally" flowable or rendered flowable using appropriate operations (e.g., processing, etc.) or appropriate conditions (e.g., temperature, etc.), etc.

"Coupled" means that (coupled) elements communicate with one another, either fluidically (i.e., fluid can flow between the two coupled elements), mechanically (i.e., a force, etc., exerted or experienced by a coupled element can affect other elements that are coupled to it), optically, etc. Coupled elements can be physically attached to one another, but this is not necessary. For example, in some instances, two coupled elements will be attached to a third element, but not directly to one another.

Some of the fluid-handling systems that are described in this specification are multifunctional. That is, they are capable of providing a variety of fluid-handling functions. In particular, fluid-handling systems in accordance with the illustrative embodiment are capable of providing one or more of the following functions, in addition to any others:

Receiving and storing one or more fluids.

Mixing two or more fluids.

Accurately dispensing fluid.

Regulating a flow of fluid.

The configuration of a fluid-handling system in accordance with the illustrative embodiment is dependent, to some extent, on its intended use and on the Theological properties of the fluid being handled. In other words, certain features are included in some variations of the illustrative embodiment but not in some others, as a function of the intended use of the fluid-handling system and the nature of the fluid(s). Yet, all fluid-handling systems described herein have certain common elements, as described below.

Figure 1:
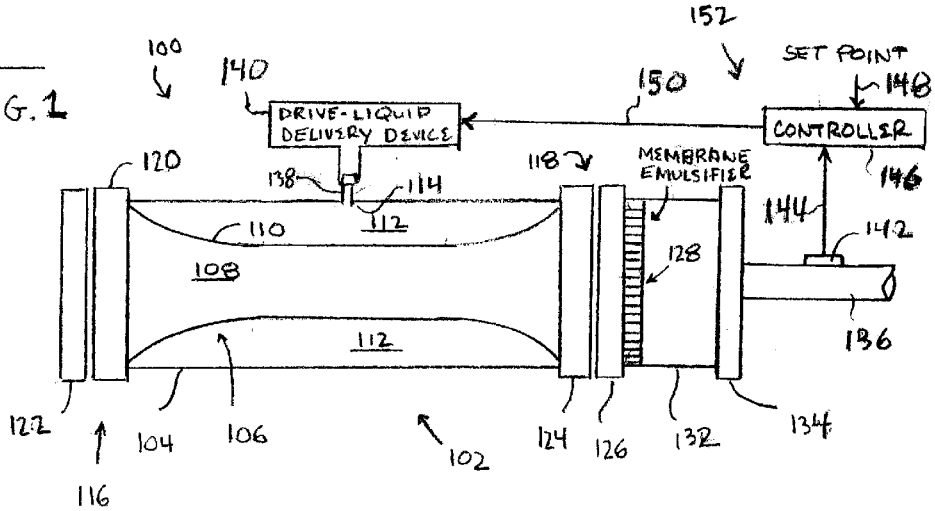
FIG. 1 depicts a fluid-handling system in accordance with the illustrative embodiment of the present invention. The fluid-handling system includes a cartridge having a housing, and a bladder in the housing.

FIG. 1 depicts fluid-handling system 100 in accordance with the illustrative embodiment of the present invention. Basic to all embodiments of a fluid-handling system in accordance with the present invention is cartridge 102. Cartridge 102 consists of housing 104 and bladder 106. In the illustrative embodiment, bladder 106 and housing 104 are coaxial with respect to one another, with bladder 106 disposed within housing 104.

Housing 104 is advantageously substantially non-expandable. In a typical implementation, housing 104 is a section of rigid plastic pipe or metal pipe. In some alternative implementations, housing 104 is flexible along the axial direction (i.e., along its length), while remaining substantially non-expandable in the radial direction. One example of a material that is flexible in the axial direction but non-expandable in the radial direction is braided Tygon™ tubing. Those skilled in the art will be able to select material that is suitable for use as housing 104.

Bladder 106 has interior volume 108 and exterior surface 110. In some variations of the illustrative embodiment, bladder 106 is elastic and resilient (i.e., like a balloon). Those skilled in the art will know how to make or otherwise obtain an elastic and resilient bladder, such as by using elastomers (e.g., silicone, Kalrez™ available from Dupont, etc.). In some other variations, bladder 106 is not elastic nor resilient (i.e., like a thin-wall propylene bag, etc.). Regardless of its elasticity and resilience, it is important that bladder 106 is chemically resistant to all fluids to which it is exposed. Bladder 106 is attached to housing 104 in well-known fashion, such as, for example, using adhesives, thermal fusion, compression, etc. In some variations, bladder 106 is not attached to housing 104; it is removable (see, FIG. 4B and accompanying description).

Although cartridge 102 is, as previously noted, basic to all embodiments of a fluid-handling system in accordance with the illustrative embodiment, the illustrative physical configuration or arrangement of cartridge 102 depicted in the Figures (i.e., cylindrical bladder 106 in a cylindrical housing 104) is merely illustrative. In some variations of the illustrative embodiment, other housing/bladder geometries (e.g., spherical, etc.) and, as described in further detail later in this specification, other specific implementations of a housing, are used.

With continuing reference to the illustrative embodiment depicted in FIG. 1, flanges 120 and 124 are attached to respective ends 116 and 118 of housing 104. Flanges 120 and 124 each have a centered opening, which is advantageously about equal in size to the outside diameter of bladder 106. Flanges 120 and 124 facilitate attaching cartridge 102 to other devices (e.g., reservoirs, conduits, valves, additional cartridges, auxiliary housings, etc.). The openings in flanges 120 and 124 also enable fluid to flow, under appropriate conditions, from bladder 106 to these other devices. As appropriate, flanges 120 and/or 124 can be capped (i.e., plugged). For example, in fluid-handling system 100 depicted in FIG. 1, flange 120 (disposed at end 116 of housing 104) is capped by end cap 122. Alternatively, flanges 120 and/or 124 can be connected to a flange that has an opening to enable fluid to flow out of interior volume 108 of bladder 106. In FIG. 1, flange 126, which has an opening to enable fluid to pass, is attached to flange 124 (at end 118 of housing 104).

Fluid-handling system 100 depicted in FIG. 1 includes some optional elements. As previously mentioned, the inclusion of these optional elements in any particular variation of the illustrative embodiment is primarily dependent upon the intended use of the fluid-handling system and the rheological properties of the fluid. The optional elements depicted in FIG. 1 are mixing device 128 (e.g., static mixer, diffuser, membrane emulsifier, etc.), drive-liquid delivery device 140, and control system 152. Some additional optional elements are described later in this specification. Further optional elements that are known to those skilled in the art, but that are not explicitly mentioned herein, can suitably be used in conjunction with the illustrative embodiment, as desirable.

In the illustrative embodiment depicted in FIG. 1, optional mixing device 128 is a membrane emulsifier that emulsifies fluids expelled from bladder 106. Membrane emulsifier 128 is disposed in a short segment of an auxiliary housing 132. Flange 134, which includes an opening to pass fluid, is attached to auxiliary housing 132. Resilient tube 136 couples to emulsifier 128 and the opening in flange 134 to dispense fluid from bladder 106.

Optional drive-liquid delivery device 140 is coupled to fitting 138, which, in turn, is coupled to the interior of housing 104 via hole 114. In the illustrative embodiment, the drive-liquid is primarily used for expelling fluid from interior volume 108 of bladder 106.

Drive-liquid delivery device 140 can be any type of system that is suitable for introducing liquid (hereinafter "drive-liquid") into housing 104. Drive-liquid delivery device 140 is advantageously capable of pressurizing the drive-liquid. In some embodiments, drive-liquid delivery device 140 is a pump, such as a positive-displacement pump. One type of pumping system that is particularly well suited for this service is an infusion pump, as is well known in the art. Infusion pumps are typically microprocessor controlled and use an actuator to actuate a piston-, roller- or peristaltic-type pumping mechanism. A common implementation of a piston-type pumping mechanism is a syringe. The use of drive-liquid delivery device 140 is described in more detail later in this specification.

Optional control system 152 enables cartridge 102 to be used as a flow regulator. In the embodiment depicted in FIG. 1, control system 152 includes sensor 142 and controller 146. Sensor 142 senses a parameter that is indicative of the rate of flow or pressure of fluid that is flowing through tube 136. Sensor 142 outputs signal 144, which is representative of the magnitude of the parameter, to controller 146. Controller 146 also receives set-point signal 148. The set point signal is compared to sensor output signal 144 and a deviation is determined. Controller 146 generates control signal 150, as a function of this deviation, and outputs it to drive-liquid delivery device 140 (i.e., the final control element). The operation of drive-liquid delivery device 138 is automatically adjusted to increase or decrease the pressure/flow of drive-liquid into housing 104 responsive to control signal 150. Those skilled in the art will how to make and use control system 152.

Further description of some of the capabilities of a fluid-handling system in accordance with the illustrative embodiment, and variations thereof, is now provided.

Figure 2:
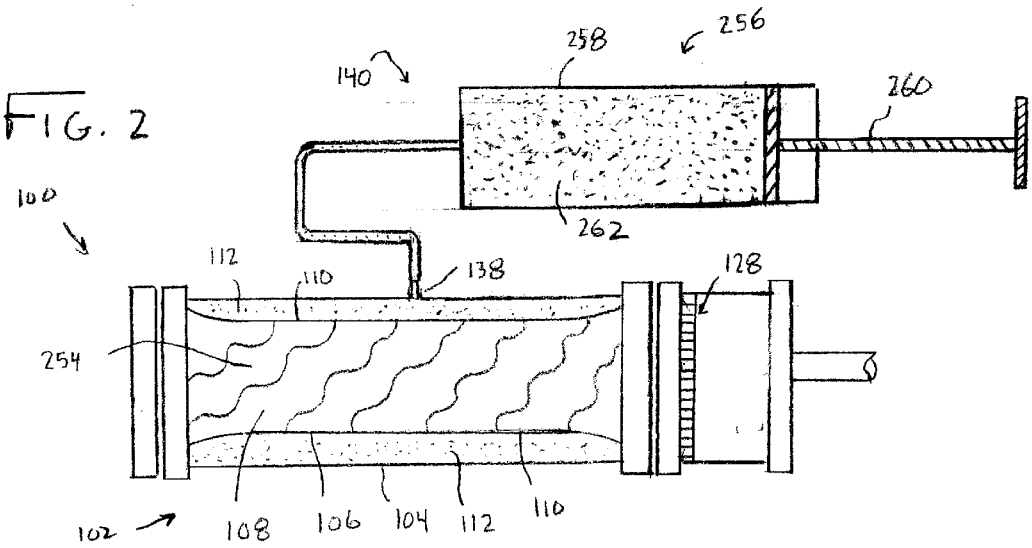
FIG. 2 depicts a fluid-handling system having a cartridge as in FIG. 1, wherein the bladder of the cartridge contains fluid.
Figure 3:
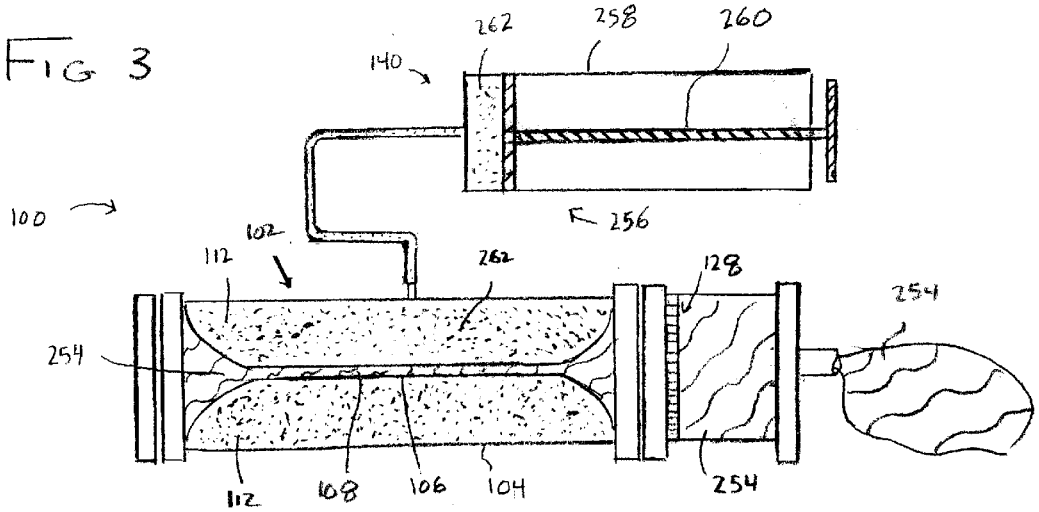
FIG. 3 depicts the fluid-handling system of FIG. 2 after fluid is dispensed from the bladder.
Figure 13:
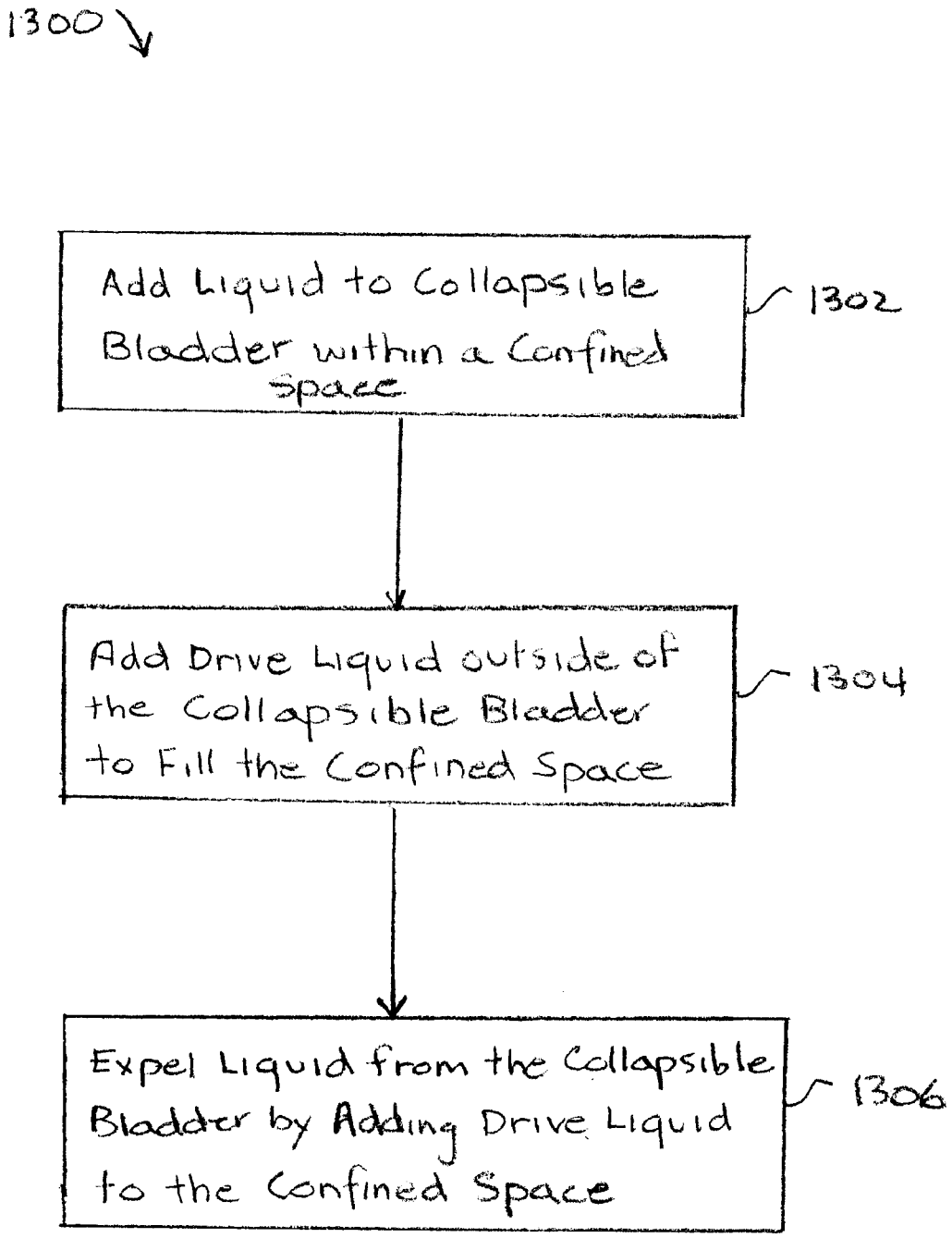
FIG. 13 depicts a method for dispensing fluid in accordance with the illustrative embodiment of the present invention.

FIGS. 2 and 3 depict a variation of fluid-handling system 100 that is physically adapted for dispensing a fluid from interior volume 108 of bladder 106. FIG. 13 depicts a method 1300 for accurate dispensing of fluid in accordance with the illustrative embodiment of the present invention.

In the variation of the illustrative embodiment that is depicted in FIGS. 2 and 3, fluid-handling system 100 includes cartridge 102, which consists of housing 104 and bladder 106, mixing device 128, and drive-liquid delivery system 140. For pedagogical purposes, and to focus the description on features that are germane to an understanding of the present invention, drive-liquid delivery system 140 is depicted simply as syringe 256, having body 258 and plunger 260. It will be understood by those skilled in the art that this is an oversimplification; drive-liquid delivery system 140 will typically include additional equipment, such as an actuator, microprocessor, etc. Those skilled in the art will know how to make and use drive-liquid delivery system 140.

According to operation 1302 of method 1300 (see FIG. 13), and as depicted in FIG. 2, interior volume 108 of bladder 106 is filled with fluid 254. Fluid 254 is composed of one or more fluid ingredients. The manner in which bladder 106 is filled is described later in this specification.

Fluids that are suitable for use in conjunction with the illustrative embodiment include, in addition to easily-handled liquids (e.g., low viscosity, Newtonian, etc.) and gases, very high viscosity liquids (e.g., viscosities greater than about 20,000 centistokes), high-solids-concentration liquid suspensions and slurries, non-Newtonian fluids, polymerizable materials, etc. Examples of some liquids that might be problematic for use in prior art fluid-handling systems, but that are suitable for use with the fluid-handling systems described herein include, without limitation, formulations or formulation ingredients for:

- personal-care products (e.g., shampoo, perfume, etc.);
- household cleaning products (e.g., liquid dishwashing detergents and clothes-cleaning detergents, etc.);
- foods (e.g., cream cheese, ice cream, margarine, mustard, etc.);
- industrial lubricants and cleaning products;
- adhesives (e.g., glues, resins, etc.);
- paints and coatings;
- pharmaceutical products; and
- electronic "chemicals" (e.g., solder masks, etch resist masks, etc.).

In preparation for expelling fluid 254 from bladder 106, drive-liquid 262 is added to region 112 (see, FIGS. 1 and 2), which is defined as the region between the interior surface of housing 104 and exterior surface 110 of bladder 106. Drive-liquid 262, which is advantageously water or other "clean" and inert liquid that is easy to pump, etc., is stored in body 258 of syringe 256. Drive liquid 262 is added to region 112 by depressing plunger 260 of syringe 256, which displaces drive-liquid 262 from syringe body 258 and through hole 114 (see, FIG. 1) via fitting 138. Drive-liquid 262 is added to region 112 until the interior volume of housing 104 is fluid full (i.e., full of fluid 254 within bladder 106 and drive-liquid 262 in region 112) in accordance with operation 1304 of method 1300 (see, FIG. 13). Advantageously, fluid 254 is not expelled from bladder 106 until drive-liquid 262 is pressurized.

FIG. 3 depicts the dispensing operation. To dispense fluid 254, plunger 260 is depressed further to force drive-liquid 262 into region 112. As a force is applied to depress plunger 260, drive-liquid 262 in syringe body 258 and in region 112 is pressurized. As the pressure of drive-liquid 262 overcomes the resistance of fluid 254 to flow, the fluid is expelled from bladder 106. As fluid 254 is expelled, bladder 106 collapses and drive-liquid 262 flows into region 112. Continued force on plunger 260 maintains the pressure on bladder 106. The expulsion of fluid 254 continues, thereby causing the continued collapse of bladder 106. Drive-liquid 262 continues to flow into region 112. See, FIG. 13, operation 1306 of method 1300.

In preparation for re-filling bladder 106 with additional fluid, drive-liquid 262 is withdrawn from housing 104. This can be done, for example, by drawing a vacuum (e.g., withdrawing plunger 260 from syringe body 258, etc.) on housing 104.

Fluid-handling system 100 and method 1300, in accordance with the illustrative embodiment of the present invention, provide several important advantages over the prior art. One advantage is that since housing 104 is non-expandable and, in some variations, fluid full (in preparation for dispensing), and since drive-liquid 262 is incompressible, each volumetric increment of drive-liquid 262 that is added to region 112 results in an equal volume of fluid 254 being dispensed. Consequently, in accordance with method 1300, a desired volume of fluid can be accurately dispensed from cartridge 102 when the cartridge is incorporated in fluid-handling system 100 having drive-liquid delivery device 140, as depicted in FIGS. 2 and 3. It should be understood, however, that dispensing can begin before region 112 is fluid full (e.g., with air present, etc.) but there will not be a one-to-one volumetric ratio of drive-liquid 262 "in" to fluid 254 "out."

A second advantage of fluid-handling system 100 for dispensing fluid is that the fluid being dispensed (e.g., fluid 254), which might present problems for a pump, etc., due to its Theological properties, etc., is indirectly "pumped" during the dispensing operation. That is, it is drive-liquid 262, rather than fluid 254, that passes through drive-liquid delivery system 140. Since drive-liquid 262 is typically water or another clean, inert (to the structures that it contacts), low-viscosity liquid, the maintenance requirements of the pressurizing system (e.g., pump, etc.) are decreased, the life of the system is extended, and the need for repeated cleaning after successive runs is alleviated. To change the fluid (i.e., fluid 254) that is being dispensed, cartridge 102 is simply disconnected from drive-liquid delivery device 140 (e.g., syringe 256) and a replacement cartridge is attached or a replacement bladder is inserted into housing 104. The disconnected cartridge can be discarded, or bladder 106 can be removed from it and replaced with a new bladder.

Cartridge 102 is an improvement of an earlier device that is disclosed in U.S. Pat. No. 5,273,406. The device disclosed in that patent is a pressure-actuated, valve-less, peristaltic pump. The pump consists of a plurality of segments that are coupled to one another. The segments are similar in structure to the cartridges that are disclosed herein. In particular, the segments include a bladder that is disposed within a rigid or non-expandable housing. According to the patent, each segment is actuated by supplying pressurized air into the region between the housing and the bladder. Due to the applied air pressure, the bladder collapses forcing fluid into an adjacent segment. Actuation is continued segment-by-segment to sequentially move a fluid through the pump in a fashion that closely resembles human peristalsis.

Using pressurized air to drive the segments, as described in U.S. Pat. No. 5,273,406, results in a sluggish response (e.g., time delay, non-proportional response due to the compressibility of air, etc.) It has since been discovered that by pre-filling the segments with drive-liquid between the bladder and the housing, the response of the segments is improved (as to accuracy as well as repeatability). Furthermore, the addition of elements such as valves (the use of which was specifically avoided in the peristaltic pump), feed tubes and a control system creates a liquid-handling system having far greater capabilities, better accuracy, and repeatability than the peristaltic pump. Additionally, the drive-liquid method prevents "back-flow," such that the check valves that were required in U.S. Pat. No. 5,273,406 are optional in many applications (e.g., single-cartridge systems, non-flow-through cartridges, etc.) for the present invention.

FIG. 4A depicts a variation of fluid-handling system 100 that is suitable for formulating products from a plurality of fluid ingredients. In the variation that is depicted in FIG. 4A, fluid is added to bladder 106 using tubes, such as tubes 464, 466, and 468. While three tubes are used in the variation that is depicted in FIG. 4A, fewer tubes or a greater number of tubes can be used, as appropriate as a function of application-specifics.

In the variation of the illustrative embodiment that is depicted in FIG. 4A, tubes 464, 466, and 468 are inserted through end cap 122 and flange 120. In a previous embodiment, end cap 122 completely plugged flange 120. In this variation, end cap 122 has holes that enable tubes 464, 466, and 468 to be inserted into bladder 106. Also, whereas flange 126 formerly contained an opening for fluid to pass, in this variation, flange 126 completely plugs end 118 of cartridge 102.

The end (of each tube) that is outside of cartridge 102 is coupled to ingredient-delivery device(s) 463 for urging fluid through the tubes and into bladder 106. The ingredient-delivery device can be, for example, a positive-displacement device, or other means (e.g., pressure supply, etc.). In appropriate situations, the fluid can be gravity fed to bladder 106. Tubes 464, 466, and 468 advantageously deliver three different fluid ingredients 470, 472, and 474, respectively, to bladder 106.

The tubes, which are depicted as simple cylindrical segments in FIG. 4A, can be tapered or have any other suitable shape, as desired, and can also be terminated by reducing nozzles or vortexing nozzles, etc., for better mixing. In some variations, such as the one depicted in FIG. 4A, the tubes terminate at different positions (i.e., protrude a different distance) within bladder 106. In some other variations, the tubes terminate at substantially the same position (i.e., protrude substantially the same distance) within bladder 106. In yet a further variation, rather than filling bladder 106 via tubes, cartridge 102 receives a pre-filled bladder 106, as depicted in FIG. 4B. More particularly, bladder 106 having only one open end 475 is pre-filled with one or more fluid ingredients and then inserted in housing 104.

As mentioned above, the variation of the illustrative embodiment depicted in FIG. 4A is particularly advantageous for use in producing fluid formulations. Once produced, the formulation can be stored in bladder 106. In other variations of the illustrative embodiment, cartridge 102 is used to store the fluid ingredients in an unmixed state. This can be implemented in a variety of ways, a few of which are described below.

For example, in one configuration (not shown) that is suitable for storing and transporting ingredients in an un-mixed state, bladder 106 is compartmentalized using spaced "iris diaphragms" (analogous to an iris diaphragm such as is used in a camera to regulate the amount of light admitted). The iris diaphragms can be formed, for example, by overlapping appropriately-shaped pieces of polymer that depend from the interior of bladder 106. Tubes (e.g., tubes 464, 466, and 468, etc.) are admitted through the hole in each "iris" and are used to deliver fluid ingredients to the appropriate compartment in bladder 106.

FIGS. 5 and 9 depict two additional illustrative variations of fluid-handling system 100 that are capable of storing and transporting fluid ingredients in an un-mixed state.

In the variation depicted in FIGS. 5 (side-view cross section) and 6 (end-view cross section), fluid-handling system 100 includes cartridge 102 having four collapsible tubes 576, 578, 580, and 582 that are located within bladder 106. The tubes each contain a fluid ingredient. In other embodiments, cartridge 102 can contain more tubes or fewer tubes as required. The tubes are advantageously, but not necessarily, affixed to one of the flanges (e.g., flange 120). The length and diameter of each tube determines the amount of fluid that it can contain. The tubes (e.g., tubes 576, 578, 580, and 582) can be sealed at both ends, or, as might be appropriate as a function of tube diameter, a free end (i.e., the end that is not affixed to a flange) can be left unsealed relying on capillary forces to retain the fluid. It is advantageous for an air pocket to be provided behind the fluid ingredient in the tube. The air pocket facilitates discharge of fluid from the tube. Region 584 is advantageously devoid of tubes.

To mix the fluid ingredients (e.g., formulate a product, etc.) that are present in tubes 576, 578, 580, and 582, the fluid is ejected from the tubes. This can be done in the manner previously described. That is, as depicted in FIG. 7, a drive-liquid delivery device is coupled to housing 104 so that drive-liquid 262 is delivered to region 112 between the interior surface of housing 104 and the exterior of bladder 106. As drive-liquid 262 enters region 112 and causes bladder 106 to collapse, the tubes collapse. As a consequence, fluid is expelled from tubes 576, 578, 580, and 582. Fluid from the tubes is delivered to open region 584 (see, FIG. 5), which is devoid of tubes to facilitate receipt of the fluid.

In some variations of the illustrative embodiment, the tubes have a physical adaptation to aid their collapse. FIGS. 8A through 8C illustrate one such physical adaptation, and show a sequential collapse of a tube as a consequence of an applied pressure.

FIG. 8A depicts, before collapse, tube 886 having two notches 888A and 888B at diametrically-opposed locations. Notches 888A and 888B run axially along the full length of tube 886 (this attribute is not visible from the cross-sectional views that are shown in FIGS. 8A through 8C). Notches 888A and 888B reduce the amount of pressure that is required to fully collapse and discharge tube 886. Furthermore, the notches result in an improvement in the linearity of response between the applied pressure (i.e., as applied by drive fluid 262, etc.) and the reduction in volume of tube 886. Additionally, notches 888A and 888B determine the folding pattern of tube 886 as it collapses, thereby enabling proper positioning of various tubes in bladder 106.

As depicted in FIG. 8B, when pressure, P, is applied to the exterior of tube 886, it begins to collapse, as facilitated by notches 888A and 888B. Collapsing tube 886 has an ellipsoidal shape, wherein notches 888A and 888B align with the long axis. FIG. 8C depicts an extreme state of collapse, wherein tube 886 is substantially flattened. In this state, most of the fluid that was contained in tube 886 will have been expelled.

Notched tubes having notches with a depth that is about fifty percent of the wall thickness are suitable for this use. For example, a tube having a one inch inside diameter, with ⅛ inch wall thickness and 1/16 inch notch thickness has been found to be suitable.

Figure 9A:
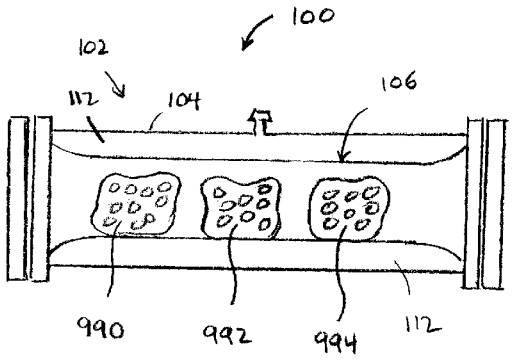
FIG. 9A depicts a variation of the fluid-handling system of FIG. 1 wherein open-cell sponges containing fluid are disposed in the bladder.

FIG. 9A depicts another variation of fluid-handling system 100 that is capable of storing and transporting fluid ingredients in an un-mixed state. In the variation depicted in FIG. 9A, fluid-handling system 100 includes cartridge 102 having three open-cell sponges 990, 992, and 994 that are located within bladder 106. Each open-cell sponge retains one (or more) fluid ingredient(s). In other embodiments, cartridge 102 can contain more sponges or fewer sponges as desired.

Figure 9B:
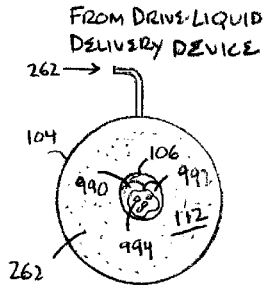
FIG. 9B depicts an end view cross section of the fluid-handling system of FIG. 9A as fluid is squeezed out of the sponges.

To mix the fluid ingredients (e.g., formulate a product, etc.) that are present in open-cell sponges 990, 992, and 994, the fluid ingredients must be removed from the sponges. This can be done in the manner previously described. That is, a drive-liquid delivery device is coupled to housing 104 so that drive-liquid 262 is delivered to region 112 between the interior surface of housing 104 and the exterior of bladder 106. As drive-liquid 262 enters region 112 and causes bladder 106 to collapse, sponges 990, 992, and 994 are squeezed, and fluid is expelled. Fluid expulsion is depicted in FIG. 9B.

In a further variation of fluid-handling system 100 that is capable of storing and transporting fluid ingredients in an un-mixed state, cartridge 102 contains small spheres (not depicted). The spheres, which typically have a diameter in the range of about 10 mm to 25 mm, have an interior void for retaining one or more fluid ingredients. In some variations, the spheres release their contents when bladder 106 collapses. In some other variations, the spheres release their contents as they are expelled from cartridge 102 (i.e., through a nozzle, etc., that causes the spheres to rupture). Furthermore, some variations include a mixture of spheres that release their contents within bladder 106 and those that release their contents when they are expelled from the bladder. The integrity of the spheres is advantageously easily disrupted so that the fluid ingredients can be released as desired. This can be accomplished, in one variation, by forming the sphere such that a small hole remains in the surface of the sphere.

The variations of fluid-handling system 100 that have been described thus far have had a single cartridge 102. In some additional variations of the illustrative embodiment, fluid-handling system 100 has two or more cartridges 102 that are attached to one another. Such embodiments are particularly useful for mixing fluid ingredients and for conducting product development studies.

Figure 10:
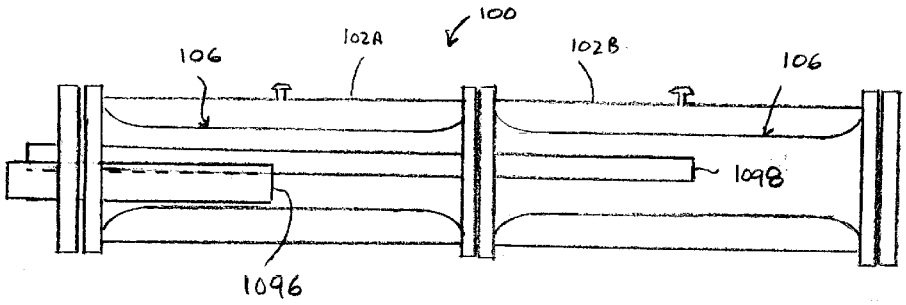
FIG. 10 depicts a variation of the fluid-handling system of FIG. 1 wherein the system includes two cartridges, each with a bladder contained within a housing. The system also includes tubes that deliver fluid into the bladder within one or the other of the two housings.

FIG. 10 depicts multi-cartridge fluid-handling system 100 in accordance with a variation of the illustrative embodiment of the present invention. Fluid-handling system 100 depicted in FIG. 10 has two cartridges 102A and 102B that are coupled together. It will be appreciated that in other variations, more than two cartridges can be coupled together.

Tube 1096 enters bladder 106 of cartridge 102A. Tube 1098 passes through cartridge 102B into bladder 106 cartridge 102B. Tube 1096 delivers a first fluid ingredient into bladder 106 of cartridge 102A. Similarly, tube 1098 delivers a second fluid ingredient into bladder 106 of cartridge 102B. A third tube (not depicted), can be used to add a third fluid ingredient to cartridge 102A or to 102B.

In some cases, the order in which fluid ingredients are combined might effect the quality (e.g., color, taste, efficacy, etc.) of a formulated product. Multi-cartridge fluid-handling system 100 can be used to permute the order, for example, in which ingredients are added to one another. As an example, assume that in a first experiment, a third fluid ingredient is added to a first fluid ingredient in cartridge 102A. Assume that this mixture is then added to a second fluid ingredient that is in cartridge 102B. (Inter-cartridge mixing can be accomplished using the system depicted in FIG. 11, for example.) In a second experiment, the third fluid ingredient is first added to a second fluid ingredient, which is in cartridge 102B. That mixture is then added to the first fluid ingredient in cartridge 102A. The formulations that result from the first experiment and the second experiment can be appropriately analyzed to determine if there is any preference for one of the mixing orders (i.e., if one of the orders results in a better product).

It will be appreciated that the configuration depicted in FIG. 10 is scalable to include many more tubes for delivering more fluid ingredients, or to include many more cartridges, or both. Furthermore, it is notable that in FIG. 10, tube 1098 is depicted as passing through first cartridge 102A. In some other variations, tube 1098 is inserted directly into second cartridge 102A (i.e., without passing through first cartridge 102A). This can be accomplished, for example, by positioning an auxiliary housing (e.g., see, FIG. 1, auxiliary housing 132) between cartridges 102A and 102B.

Figure 11:
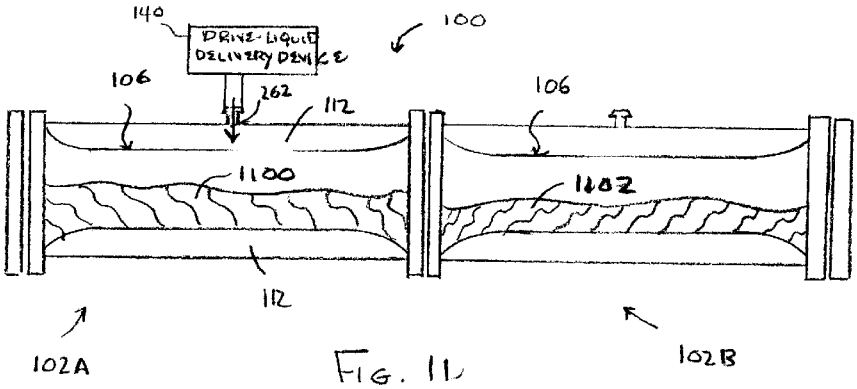
FIG. 11 depicts the fluid-handling system of FIG. 10 but without tubes and with at least one drive-liquid delivery device.

FIG. 11 depicts a further variation of a multi-cartridge fluid-handling system in accordance with the illustrative embodiment of the present invention. This variation is particularly useful for mixing fluids that have been delivered to the cartridges. Like the variation that is depicted in FIG. 10, system 100 that is depicted in FIG. 111 includes two cartridges 102A and 102B that are coupled to one another. In some other variations, more than two cartridges are coupled together.

With continuing reference to FIG. 11, bladder 106 of cartridge 102A contains a first fluid ingredient 1100. Similarly, bladder 106 of cartridge 102B contains a second fluid ingredient 1102. These ingredients can be delivered to bladders 106 by tubes, for example, such as tubes 1096 and 1098 that are depicted in FIG. 10. In the variation that is depicted in FIG. 11, at least one of the cartridges—in this case cartridge 102A—is coupled to drive-liquid delivery device 140.

As drive-liquid delivery device 140 forces liquid 262 into region 112 of cartridge 102A, bladder 106 collapses in the manner previously described. The collapse of bladder 106 forces fluid 1100 into cartridge 102B to mix with fluid 1102. In variations in which a drive-liquid delivery device is also coupled to cartridge 102B, the formulation consisting of fluids 1100 and 1102 can be moved back and forth between cartridges 102A and 102B, increasing mixing action.

In yet some further variations, mixing action is enhanced by positioning a mixing device (e.g., dynamic mixer, static mixer, diffuser, membrane emulsifier, etc.) between two cartridges, such as cartridges 102A and 102B.

The variation of fluid-handling system 100 that is depicted in FIG. 111 can, therefore, be used to mix fluid ingredients after they have been delivered to the various cartridges (such as by the configuration of system 100 that is depicted in FIG. 10).

It is desirable, in some applications, to prevent back-flow of fluid from a downstream cartridge (e.g., cartridge 102B) to an upstream cartridge (e.g., cartridge 102A). A "check valve," which is disposed between the two cartridges (in an auxiliary housing, etc.), is advantageously used for this purpose. The check valve can be implemented as two resilient flaps of material (e.g., rubber, etc.) that depend from the inside walls of the auxiliary housing. The flaps readily part when subjected to the pressure of a fluid flowing from the upstream cartridge to a downstream cartridge. But any pressure against the flaps in the upstream direction causes the flaps to press more tightly together, preventing back-flow. Alternatively, various other configurations suitable for providing the functionality of a check valve, as will occur to those skilled in the art in view of this description, can suitably be used.

In yet additional variations of the illustrative embodiment, fluid-handling system 100 is physically adapted to regulate a flow of fluid. Such a system can have a variety of configurations, one of which is depicted in FIG. 12.

Figure 12:
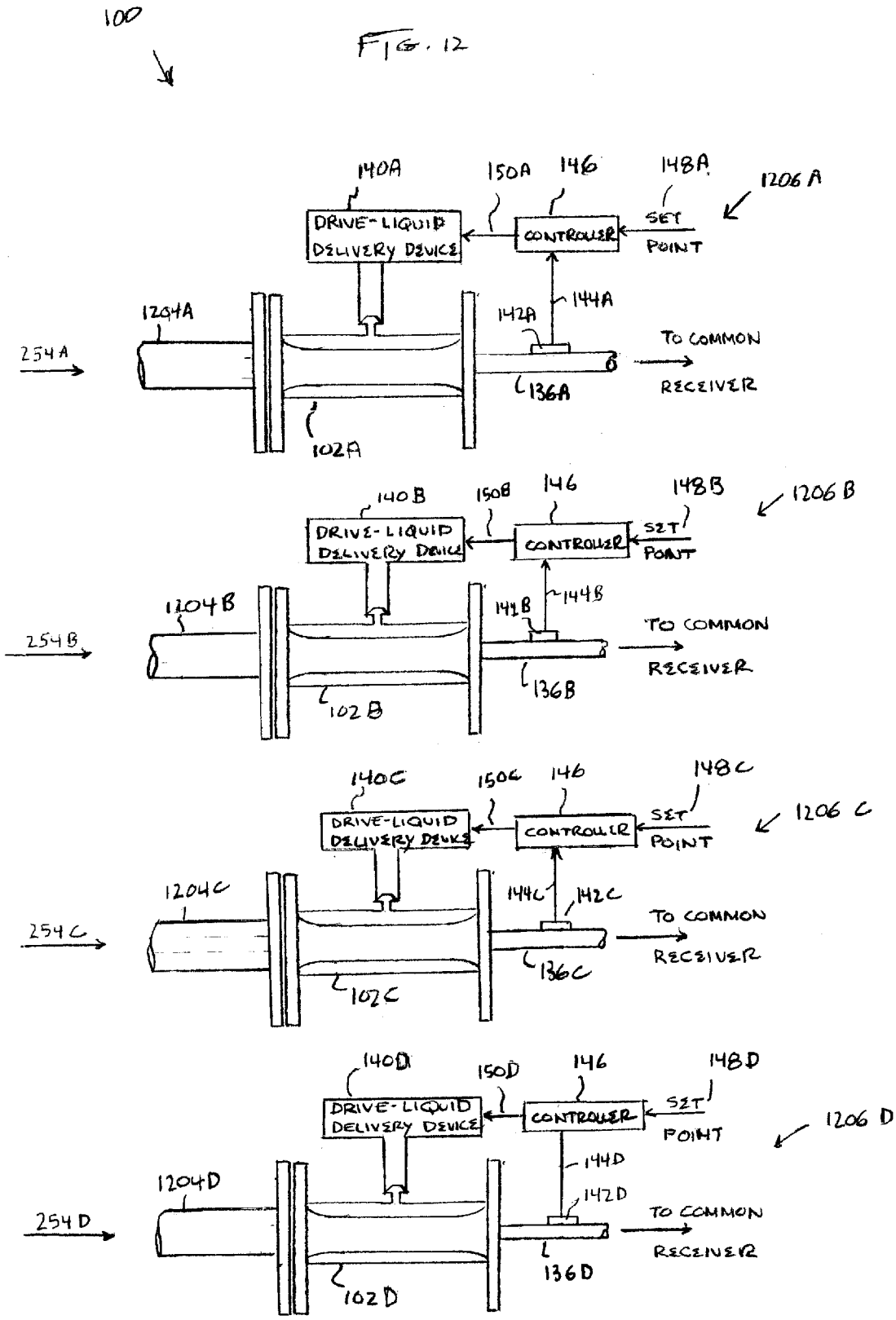
FIG. 12 depicts a variation of the fluid-handling system of FIG. 11 wherein the system includes a plurality of dual-cartridge arrangements for regulating the flow of fluid into a common receiver.

The system depicted in FIG. 12 includes four cartridges 102A, 102B, 102C, and 102D, and respective associated control systems 1206A, 1206B, 1206C, and 1206D that operate in parallel with one another to control the flow of four fluid ingredients to a common receiver. In fluid-handling system 100 that is depicted in FIG. 12, each of the four cartridges and their associated control systems are identical to one other and function in the same fashion. Consequently, the operation of only one of the cartridges (i.e., 102A) and its associate control system (i.e., 1206A) is described here.

Cartridge 102A regulates a flow of fluid 254A into a common receiver (not depicted). Cartridge 102A receives fluid 254A from conduit 1204A. In some applications, conduit 1204A is fed by a reservoir (not depicted), which can be implemented in any convenient form. For example, in some variations, another cartridge 102, which is typically far larger (i.e., has a greater volumetric capacity) than cartridge 102A, can serve as a reservoir.

Control system 1206A, which in this embodiments includes sensor 142A and controller 146, generates a control signal that regulates the area for flow through cartridge 102A, thereby dictating the flow rate of fluid 254A into the common receiver. In further detail, as fluid 254A exits cartridge 102A, it passes through resilient conduit 136A. Sensor 142A senses a parameter that is indicative of the flow or pressure of fluid 254A in conduit 136A. Sensor 142A generates signal 144A that is a function of the sensed parameter, and outputs it to a common controller 146, which serves all four control systems 1206A, 1206B, 1206C, and 1206D. In some other variations of the illustrative embodiment, each control system has its own controller.

Controller 146 receives sensor signal 144A and it also receives set-point signal 148A. Set-point signal 148A is indicative of a desired value of sensor signal 144A (i.e., the value that sensor signal 144A would have if the flow of fluid 254A through conduit 136A were at a desired rate). The controller compares sensor signal 144A with set-point signal 148A and calculates a deviation. Control signal 150A is generated by controller 146 as a function of the calculated deviation, and is then output to drive-liquid delivery device 140B (i.e., the final control element). The operation of drive-liquid delivery device 140B is altered to increase or decrease the area for flow through cartridge 102A, based on control signal 150A. The rate of flow of fluid 254A changes consistent with the change of flow area.

In some embodiments, sensor 142A is a force sensor, such as "FSL low profile" series force sensor "FSL05N2C" available from Honeywell of Freeport, Ill. Force sensors operate on the principle that the resistance of silicon-implanted piezo-resistors will increase when the resistors flex under any applied force. In the present context, the sensor "senses" force imparted by the fluid against elastic tube 136A. More particularly, the force is transferred to a silicon sensing element by a plunger or gel-filled membrane. The change in resistance is proportional to the applied force, and the force is proportional to the internal pressure. This change in circuit resistance results in a corresponding change in a output voltage signal from the sensor (e.g., signal 144A from sensor 142A).

This process of flow regulation occurs for each cartridge 102A, 102B, 102C, and 102D. In this fashion, a product is formulated as fluid ingredients 254A, 254B, 254C, and 254D flow, in desired proportions as a function of their controlled flow rates, into a common receiver (not depicted). In some other variations of the illustrative embodiment, cartridges deliver the fluid to destinations other than a common receiver.

In some further variations, rather than using fluid-handling system 100 as a flow regulator, it is used as a choke or accumulator to smooth out up-stream variations in flow. In such variations, the flow area through bladder 106 is typically set by introducing an amount of drive-liquid into region 112 between bladder 106 and housing 104. Although a control system (e.g., control system 1206A, etc.) can be used for such applications, in many such cases, the control system is not required.

Further variations of a fluid-handling system 100 in accordance with the illustrative embodiment of present invention are depicted in FIGS. 14A, 14B, 15A and 15B. Fluid-handling system 100 depicted in these figures includes housing 104, bladder 106, drive-liquid delivery device 140, and static mixer 128, inter-related as shown.

In these variations, bladder 106 is coupled to drive-liquid delivery device 140 (via nozzle 138). Consequently, rather than delivering drive-liquid 262 to region 112 (see, e.g., FIGS. 1–3), drive-liquid is delivered to bladder 106. And rather than being delivered to bladder 106, fluid ingredients 254 are delivered (via tubes, etc.), in the manner previously described, to the interior of housing 104 but outside of bladder 106.

FIGS. 14A and 15A depict housing 104 substantially full of fluid ingredients 254, while bladder 106 is empty. In the variation depicted in FIG. 14A, empty bladder 106 is near closed end 1406 of cartridge 102. In the variation depicted in FIG. 15A, empty bladder 106 resides at the "bottom" of cartridge 102. To expel fluid ingredients 254 from housing 104, bladder 106 is expanded, such as by filling it with drive-liquid 262. FIGS. 14B and 15B depicts bladder 106 filling with drive-liquid 262.

In the variations depicted in these figures, fluid ingredients 254 enter static mixer 128 after being expelled from housing 104. Static mixers, which are well known in the art, produce mixing in the absence of moving parts. Static mixers that are suitable for use in conjunction with fluid-handling system 100 are commercially available from Chemineer, Inc. of Dayton, Ohio and others.

Formulation 255 results from the mixing of fluid ingredients 254 in static mixer 128. Formulation 255 is dispensed or otherwise delivered to other equipment for additional processing, etc., through tube 136.

This variation (i.e., admitting drive-liquid 262 into bladder 106) has certain advantages over the illustrative embodiment (admitting fluid ingredients into bladder 106). In particular, it relatively easier to completely displace fluid 254 from housing 104 (in the variation) than from bladder 106 (in the illustrative embodiment) for fluids with low solids concentrations. Also, in the variation of the illustrative embodiment, when bladder 106 is made from non-elastic and non-resilient material, the expulsion of fluid 254 from housing 104 is proportional to the pressure flow of drive-liquid 262 into bladder 106. In other words, the applied driving force is linear. This is might not true for the illustrative embodiment, wherein the applied pressure might need to be increased as fluid 254 is expelled from bladder 106. Furthermore, for the same conditions, the force required to completely expel fluid 254 from housing 104 (in the variation) will be less than is required to completely expel fluid 254 from bladder 106 (in the illustrative embodiment).

On the other hand, it is more likely that low-flow or no-flow regions (i.e., "dead spots") will develop (in housing 104) when drive-liquid is admitted to bladder 106 than when it is admitted to region 112. The presence of such low-flow regions will be particularly problematic when handling relatively higher-solids-concentration fluids. Consequently, if fluid 254 is a high-solids-concentration liquid, it will be advantageous to use the illustrative embodiment rather than the variation described above.

It is to be understood that the above-described embodiments and variations are merely illustrative of the invention and that many other variations can be devised by those skilled in the art without departing from the scope of the invention and from the principles disclosed herein. Some further illustrative variations are described below.

In the illustrative embodiment, cartridge 102 is depicted, simply, as bladder 106 in a cylindrical housing 104. But in some variations of the illustrative embodiment, cartridge 102 is implemented such that it has the appearance of conventional packaging for a consumer product. In one such variation, cartridge 102 is implemented as a bladder in a tube, wherein the tube is configured in the manner of a tube that is used for toothpaste. In another variation, cartridge 102 is implemented as a flexible bladder in a tube, wherein the tube is configured as a shampoo container. In this manner, cartridge 102 is utilized as final packaging as well as a dispenser for consumer products. Thus, cartridge 102 might have a substantially different physical "look" as a function of the intended application (e.g. formulating products in a company's laboratory versus retail sales of a consumer product, etc.).

In the illustrative embodiment, drive-liquid delivery device 140 is described as any type of system that is suitable for introducing drive-liquid into housing 104 and that is advantageously capable of pressurizing the drive liquid. But other arrangements of a drive-liquid delivery device can suitably be used. For example, in an environment in which fluid is dispensed as a function of temperature, region 112 between housing 104 and bladder 106 can be pre-filled with liquid. As the temperature of the environment increases, cartridge 102, and the drive-liquid within it, warms. This increase in temperature will cause the drive-liquid to expand and a small amount of fluid that is within bladder 106 to dispense. Alternatively, in this embodiment wherein cartridge 102 is pre-filled and temperature is used as a driving force to expel fluid, a drive-gas can be used.

These examples are provided as an illustration of a few of the many variations that fall within the contemplated scope of the present invention. It is therefore intended that such variations be included within the scope of the following claims and their equivalents.

We claim:

1. An article comprising:

a first cartridge, wherein said first cartridge comprises:
- a first housing, wherein said first housing has:
  - a side-wall;
  - a first opening passing through said side-wall;
  - a first end;
  - a second opening disposed at said first end; and
  - a second end, wherein said second end is sealed;
- a first bladder, wherein said first bladder:
  - is disposed within said first housing; and
  - has an interior volume, an exterior surface and an opening; wherein:
    - said interior volume of said first bladder is coupled to said second opening in said first housing through said opening in said first bladder; and
    - said first bladder expels a first fluid contained in its interior volume in response to a pressure applied to said exterior surface by a drive-liquid that is introduced through said first opening;
- a first tube, wherein said first tube extends a first distance into said interior volume of said first bladder; and
- a second tube that extends a second distance into said interior volume of said first bladder.

2. The article of claim 1 further comprising a mixing device, wherein said mixing device is coupled to said second opening of first housing.

3. The article of claim 1 wherein said second distance is different than said first distance.

4. The article of claim 1 wherein said second distance is equal to said first distance.

5. The article of claim 4 wherein:

said first tube delivers a first fluid ingredient into said interior volume of said first bladder;

said second tube delivers a second fluid ingredient to said interior volume of said first bladder; and said first fluid ingredient and said second fluid ingredient compose said first fluid.

6. The article of claim 1 further comprising a control system, wherein:

said control system controls a flow parameter of said drive liquid;

said flow parameter of said drive liquid is selected from the group consisting of rate, pressure and amount;

said control system controls said flow parameter of said drive liquid as a function of a flow parameter of said first fluid;

said flow parameter of said first fluid is selected from the group consisting of rate and pressure at which said first fluid is expelled.

7. The article of claim 6 wherein said control system comprises:

a sensor, wherein said sensor senses said flow parameter of said first fluid and generates a signal indicative thereof; and a controller, wherein said controller receives said signal from said sensor, compares it to a set point, generates a control signal based on the comparison, and outputs said control signal to said drive-liquid delivery device.

8. The article of claim 1 further comprising at least one storage element that is disposed within said first bladder, wherein said storage element contains a first ingredient, and wherein said first fluid comprises said first ingredient.

9. The article of claim 8 wherein said storage element comprises a collapsible tube.

10. The article of claim 9 wherein said collapsible tube has two notches extending the length thereof, wherein said notches are disposed at diametrically-opposed locations on said collapsible tube.

11. The article of claim 1 further comprising a second cartridge, id second cartridge is coupled to said second opening of said first housing.

12. The article of claim 11 wherein said second cartridge comprises:

a second housing, wherein said second housing has a first opening and a second opening, and wherein said second opening of said second housing is coupled to said second opening of first housing; and a second bladder, wherein:

said second bladder is disposed within said second housing;

said second bladder has an interior volume and an exterior surface; and said interior volume of said second bladder is coupled to said second opening of said second housing.

13. The article of claim 12 further comprising:

a first tube that extends a first distance into said interior volume of said first bladder; and a second tube that extends a second distance into said interior volume of said second bladder.

14. A method comprising:

adding a first fluid ingredient and a second fluid ingredient to a bladder that is disposed within a non-expandable, confined space;

completely filling said confined spaced by adding a drive-liquid thereto, but outside of said bladder;

expelling said first fluid ingredient and said second fluid ingredient together from said bladder by adding an incremental volume of said drive liquid to said confined space, wherein said first fluid ingredient and said second fluid ingredient are expelled in an amount that is collectively equal to said incremental volume.

15. The method of claim 14 wherein;

adding said first fluid ingredient further comprises adding said first fluid ingredient to said bladder via a first tube; and adding said second fluid ingredient further comprises adding said second fluid ingredient to said bladder via a second tube.

* * * * *